US010889106B2

(12) United States Patent
Shaul et al.

(10) Patent No.: US 10,889,106 B2
(45) **Date of Patent: *Jan. 12, 2021**

(54) FORMATION OF A CREASE AND AN IMAGE ON MEDIA

(71) Applicant: HP INDIGO B.V., Amstelveen (NL)

(72) Inventors: Itzik Shaul, Alpharetta, GA (US); Gilad Greenberg, Ness Ziona (IL); George Trendafilov, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 16 days.

This patent is subject to a terminal disclaimer.

(21) Appl. No.: 16/197,626

(22) Filed: Nov. 21, 2018

(65) Prior Publication Data

US 2019/0084296 A1 Mar. 21, 2019

Related U.S. Application Data

(63) Continuation of application No. 14/442,341, filed as application No. PCT/EP2012/072452 on Nov. 13, 2012, now Pat. No. 10,150,285.

(51) Int. Cl.
*B41J 2/005* (2006.01)
*B41M 1/24* (2006.01)
(Continued)

(52) U.S. Cl.
CPC ..... *B41J 2/0057* (2013.01); *B41J 3/38* (2013.01); *B41M 1/24* (2013.01);
(Continued)

(58) Field of Classification Search
CPC ... B41J 2/0057; B41J 2/22; B41J 2/315; B41J 2/385; B41J 2/435
See application file for complete search history.

(56) References Cited

U.S. PATENT DOCUMENTS 6,122,468 A 9/2000 Sakamoto
8,915,831 B2 12/2014 Walker
(Continued)

FOREIGN PATENT DOCUMENTS

CN 2216911 1/1996
CN 1654225 8/2005
(Continued)

OTHER PUBLICATIONS

Tse, M-K. et al.; "Automated Test Equipment for the Development of Media for Digital Printing"; Sep. 7-11, 1998; http://www.qea.com/upload/files/Paper_1998_ICPS_Automated_Test_Equipment_for the_Development_of_Media_for_ Digital_Printing-newaddr.pdf.

*Primary Examiner* — Scott A Richmond
(74) *Attorney, Agent, or Firm* — HP Inc. Patent Department

(57) ABSTRACT

A method of forming an image and a crease on media by an image forming system includes forming a crease formation pattern on an impression media received by an impression member. The method also includes forming the image on an image forming blanket of an intermediate transfer member by a print unit. The method also includes pressing the media against the impression member by the image forming blanket to transfer the image onto the media and to establish contact with the crease formation pattern to form the corresponding crease on the media.

19 Claims, 7 Drawing Sheets

(51) Int. Cl.

| | |
|---|---|
| ***B41J 3/38*** | (2006.01) |
| ***G03G 15/16*** | (2006.01) |
| ***G03G 15/00*** | (2006.01) |

(52) U.S. Cl.
CPC ..... *G03G 15/1685* (2013.01); *G03G 15/6582* (2013.01); *B65H 2301/5126* (2013.01); *G03G 2215/00877* (2013.01)

(56) References Cited

U.S. PATENT DOCUMENTS

| | | | | |
|---|---|---|---|---|
| 9,598,260 | B2 | 3/2017 | Ooba | |
| 2002/0048662 | A1 | 4/2002 | Bredahl et al. | |
| 2003/0226460 | A1 | 12/2003 | Kim | |
| 2005/0100370 | A1 | 5/2005 | Van Den Berg et al. | |
| 2005/0180795 | A1 | 8/2005 | Kurashina | |
| 2006/0229184 | A1 | 10/2006 | Powell | |
| 2007/0116479 | A1 | 5/2007 | Mandel | |
| 2009/0062096 | A1* | 3/2009 | Sasahara | B65H 45/30 493/396 |
| 2010/0222195 | A1 | 9/2010 | Oota et al. | |
| 2011/0301005 | A1 | 12/2011 | Hattori | |
| 2012/0131516 | A1 | 5/2012 | Chiu | |
| 2012/0132093 | A1 | 5/2012 | Arraf et al. | |
| 2013/0272818 | A1* | 10/2013 | Oshima | B42C 1/00 412/22 |
| 2015/0375555 | A1 | 12/2015 | Mochizuki | |

FOREIGN PATENT DOCUMENTS

| | | | |
|---|---|---|---|
| CN | 202399582 | | 8/2012 |
| JP | H08118587 | A | 4/1996 |
| JP | 2001331043 | | 11/2001 |
| JP | 2002023507 | A | 1/2002 |
| JP | 2012181529 | | 9/2012 |
| WO | WO-2012091654 | A1 | 7/2012 |
| WO | WO-2012152327 | | 11/2012 |
| WO | WO-2013066289 | | 5/2013 |
| WO | WO-2014117819 | | 8/2014 |

* cited by examiner

FORMATION OF A CREASE AND AN IMAGE ON MEDIA

BACKGROUND

Image forming systems may include a print unit and an image forming blanket to transfer an image to media. The print unit may apply ink to a photo-imaging cylinder to form an image thereon. The photo-imaging cylinder may transfer the image to an image forming blanket. Subsequently, the image forming blanket may transfer the image to the media.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

The image forming system may include a print unit, a photo-imaging cylinder (PIP), and an image forming blanket to transfer an image to media. The print unit may apply ink to the PIP to form an image thereon. For example, the PIP may form an electrostatic image thereon to attract the ink provided by the print unit to form the image thereon. The PIP may transfer the image to an image forming blanket. Subsequently, the image forming blanket may transfer the image to the media. For example, the image forming blanket may contact one side of the media to transfer the image thereon while another side of the media is in contact with an impression media. Subsequently, additional operations may be performed on the media by off-line stations such as a crease station and/or die cutting station to prepare the media to be folded, and the like. Subsequently, the media may be folded along creases to place it in an assembled state. Such assembled media may include packages, cards, book covers, catalogs, and the like.

In examples, a method of forming an image and a crease on media by an image forming system may include formation of the image on an image forming blanket of an intermediate transfer member by a print unit. The method may also include formation of the crease formation pattern on an impression media received by an impression member. The method may also include the media being pressed against the impression member by the image forming blanket to transfer the image onto the media and to establish contact with the crease formation pattern to form the corresponding crease on the media. Accordingly, the creasing operation and image forming operation on the media may be performed in-line and at a same image forming station. Thus, the image forming system may perform image and crease formation in a cost-effective and space-efficient manner.

Figure 1:
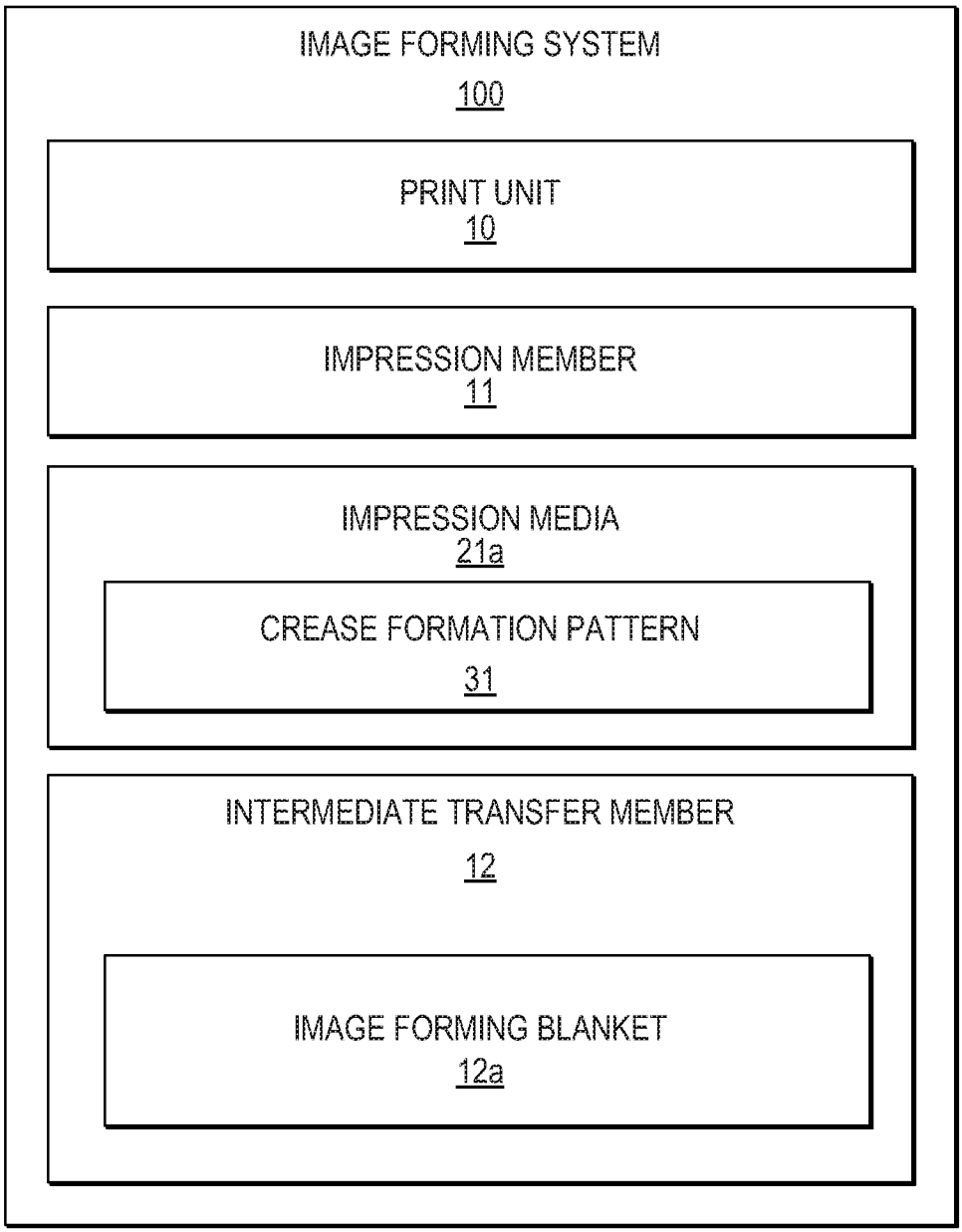
FIG. 1 is a block diagram illustrating an image forming system according to an example.

FIG. 1 is a block diagram illustrating an image forming system according to an example. Referring to FIG. 1, in some examples, an image forming system 100 includes a print unit 10, an impression member 11, and an intermediate transfer member 12 having an image forming blanket 12*a*. The print unit 10 may selectively form an image and a crease formation pattern 31. The crease formation pattern may correspond to desired placement of creases on media to enable the media to be properly folded in an assembled state. The impression member 11 may receive an impression media 21*a*. The intermediate transfer member 12 may include the image forming blanket 12*a* surrounding and in contact there with. In some examples, the intermediate transfer member 12 and the impression member 11 may be in a form of a roller, and the impression media 21*a* may be paper, and the like.

Referring to FIG. 1, in some examples, the image forming blanket 12*a* may receive and transfer the crease formation pattern 31 to the impression media 21*a*. The image forming blanket 12*a* may also press the media against the impression member 11 to transfer the image on the image forming blanket 12*a* to the media. The image forming blanket 12*a* may also press the media against the impression member 11 to establish contact between the media and the crease formation pattern 31 to form a corresponding crease on the media. The image forming system 100 may include a liquid electro photographic (LEP) apparatus, an inkjet printer, axerography apparatus, and the like. The term LEP may refer to a process of printing by applying liquid toner through an electric field onto a surface forming an electrostatic pattern to form an image. In most LEP processes, the respective image is subsequently transferred to at least one intermediate surface such as an image forming blanket 12*a*, and subsequently to the media.

Referring to FIG. 1, in some examples, the print unit 10 may form the image to be transferred by the image forming blanket 12*a* onto the media. Additionally, in some examples, the print unit 10 may also form the crease formation pattern 31 to be transferred by the image forming blanket 12*a* onto the impression media 21*a*. For example, the print unit 10 may form the crease formation pattern on a photo-imaging cylinder 24 (PIP) (FIG. 2). The PIP 24 may transfer the crease formation pattern onto the image forming blanket 12*a*. The image forming blanket 12*a* may transfer the crease formation pattern 31 onto the impression media 21*a*. The print unit 10 may also form the image on the PIP 24. The PIP 24 may transfer the image onto the image forming blanket 12*a*. Subsequently, the image may be transferred from the image forming blanket 12*a* to the media. In some examples, a crease is formed on the media corresponding to the crease formation pattern 31 during the transfer of the image from the image forming blanket 12*a* to the media. In some examples, formation of the image and crease on the media may be performed simultaneously.

Alternatively, in some examples, the image forming system 100 may include a supplemental print unit 26 (FIG. 2B) to form the crease formation pattern 31 on the impression media 21*a*. For example, the supplemental print unit 26 may directly print the crease formation pattern 31 on the impression media 21*a*. In some examples, the print unit 10 and/or supplemental print unit 26 may include an inkjet print head, a binary ink developer, and the like. The ink may include material deposited onto a surface by the image forming system 100 including liquid toners, dry toners, ultraviolet (UV) cured inks, thermally cured inks, inkjet inks, pigment inks, dye-based inks, solutions with colorant, solutions without colorant, solvent based inks, water-based inks, plastisols, and the like.

Figure 2A:
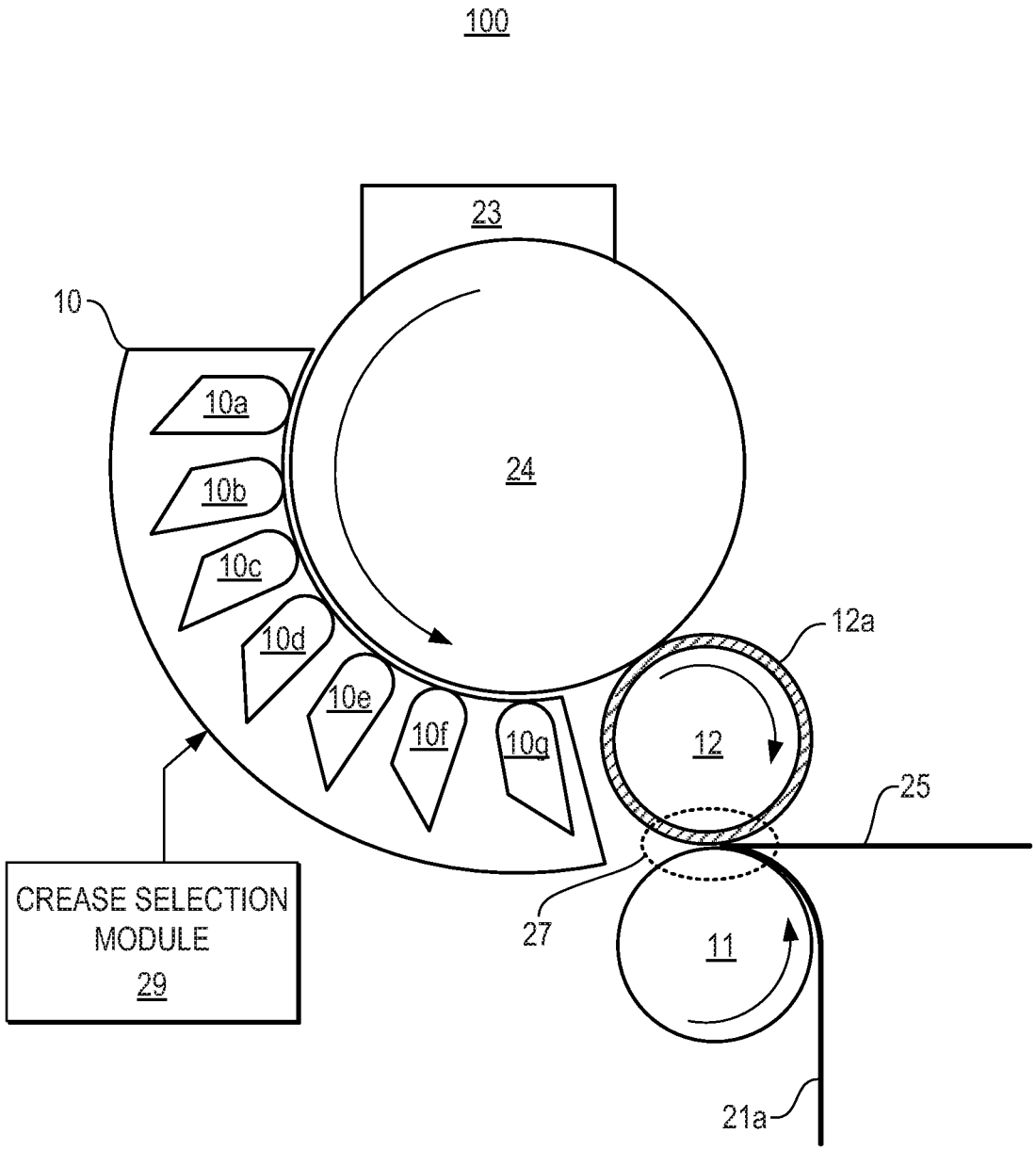
FIGS. 2A and 2B are schematic views of the image forming system of FIG. 1 according to examples.
Figure 2B:
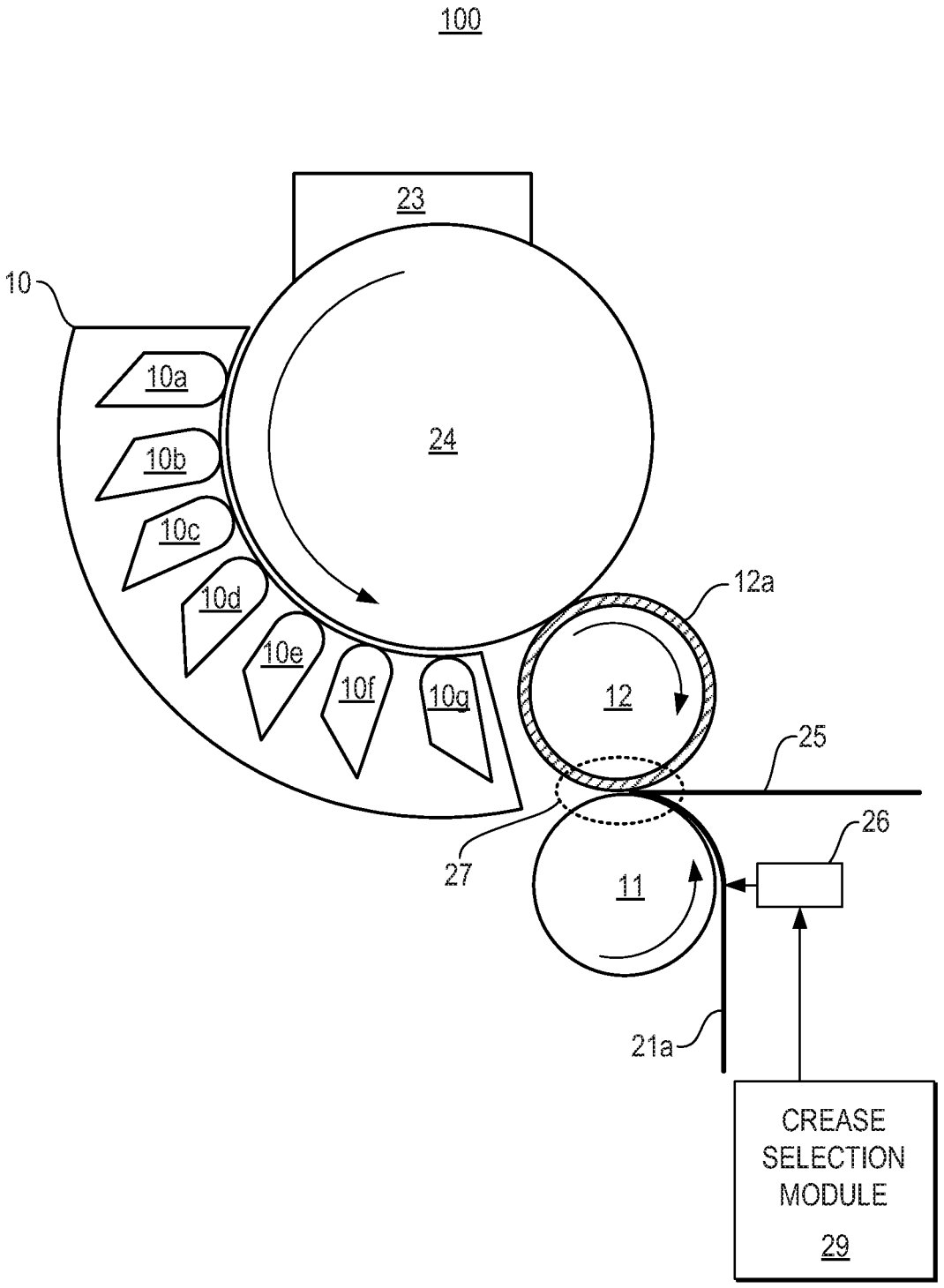

FIGS. 2A and 2B are schematic diagrams illustrating an image forming system such as an LEP apparatus according to examples. Referring to FIGS. 2A and 2B, in some examples, the image forming system 100 may include a print unit 10, a PIP 24, a photo charging unit 23, an intermediate transfer member 12 including an image forming blanket 12*a*, an impression member 11, and a crease selection module 29. The crease selection module 29 may enable selection of a crease formation pattern to be formed on an impression media 21*a*. For example, the crease selection module 29 may include a user interface such an input device and, in some examples, an output device. The crease selection module 29 may also include a selection of predefined and/or customizable crease formation patterns for a user to select.

In some examples, the crease selection module 29 may be implemented in hardware, software including firmware, or combinations thereof. The firmware, for example, may be stored in memory and executed by a suitable instruction-execution system. If implemented in hardware, as in an alternative example, the crease selection module 29 may be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the crease selection module 29 may be implemented in a combination of software and data executed and stored under the control of a computing device.

Referring to FIGS. 2A and 2B, in some examples, the image forming system 100 may form an image on media 25. The image may include text, symbols, graphics, and the like. In some examples, the image may be initially formed on the PIP 24, transferred to the intermediate transfer member 12, and then transferred to the media 25. For example, an image may be formed on the PIP 24 by rotating it under the photo charging unit 23. The photo charging unit 23 may include a charging device such as corona wire, charge roller, or other charging device and a laser imaging portion. A uniform static charge may be deposited on the PIP 24 by the photo charging unit 23. As the PIP 24 continues to rotate, it passes the laser imaging portion of the photo charging unit 23 to dissipate the static charges in selected portions of the image area to leave an electrostatic charge pattern corresponding to the image to be printed.

Referring to FIGS. 2A and 2B, in some examples, ink may be transferred onto the PIP 24 by a print unit 10. In some examples, the print unit 10 may include a plurality of binary ink developers (BIDs) 10*a*, 10*b*, 10*c*, 10*d*, 10*e*, 10*f*, and 10*g*. In some examples, a respective BID may correspond to each ink color. During printing, the appropriate BID may engage with the photo-imaging cylinder 24. The engaged BID unit may provide a uniform layer of ink to the PIP 24. For example, the ink may include electrically charged pigment particles attracted to the opposing electrical fields on the image area of the PIP 24. Additionally, the ink may be repelled from the uncharged, non-image areas forming a single color ink image on its surface. The PIP 24 may continue to rotate and transfer the image to the image forming blanket 12*a*, for example, surrounding the intermediate transfer member 12. The image forming blanket 12*a* may transfer the image to the media 25 transported into a nip 27 between the intermediate transfer member 12 having the image forming blanket 12*a* thereon and the impression member 11, for example, having an impression media 21*a* received thereon. The process may be repeated for each of the colored ink layers to be included in the final image.

In some examples, the impression media 21*a* may be impression paper to receive the crease formation pattern. For example, the crease formation pattern may be formed on the PIP 24 by the print unit 10. The PIP 24 may transfer the crease formation pattern to the image forming blanket 12*a*. Subsequently, the image forming blanket 12*a* may transfer the crease formation pattern to the impression media 21*a*. That is, the crease formation pattern may be selectively transferred from the image forming blanket 12*a* to the impression media 21*a* when the media 25 is not disposed there between (e.g., the media is not disposed in the nip 27). Accordingly, the impression media 21*a* and the crease formation pattern thereon may be disposed below the media 25. Additionally, as the media 25 and impression media 21*a* enter the nip 27, the image forming blanket 12*a* contacts and pressures the media 25 against the impression media 21*a* to transfer the image to the media 25. That is, the image forming blanket 12*a* may transfer the image to one side of the media 25 when the crease formation pattern is contacting another side of the media 25 to form a crease thereon corresponding to the crease formation pattern.

As illustrated in FIG. 2B, the image forming system 100 may include the print unit 10, the PIP 24, the photo charging unit 23, the intermediate transfer blanket 12 including the image forming blanket 12*a*, the impression member 11, and the crease formation module 29 as previously disclosed with respect to FIG. 2A. The image forming system 100 may also include a supplemental print unit 26. The supplemental print unit 26 may include an inkjet printhead, and the like, to provide ink to the impression media 21*a* to form the crease formation pattern thereon. That is, the supplemental print unit 26 may print the crease formation pattern directly on the impression media 21*a*. For example, an inkjet print head may eject ink directly onto the impression media 21*a* to form the crease formation pattern. Also, the supplemental print unit 26 may communicate with the crease selection module 29. In some examples, the supplemental print unit 26 may form multiple layers of ink on top of each other to form the crease formation pattern. That is, a subsequently-formed layer of ink having a smaller width may be formed on top of a previously-formed layer of ink having a greater width to form the crease formation pattern having a tapered end opposite to the impression media 21*a* on which the crease formation pattern is formed.

Figure 3:
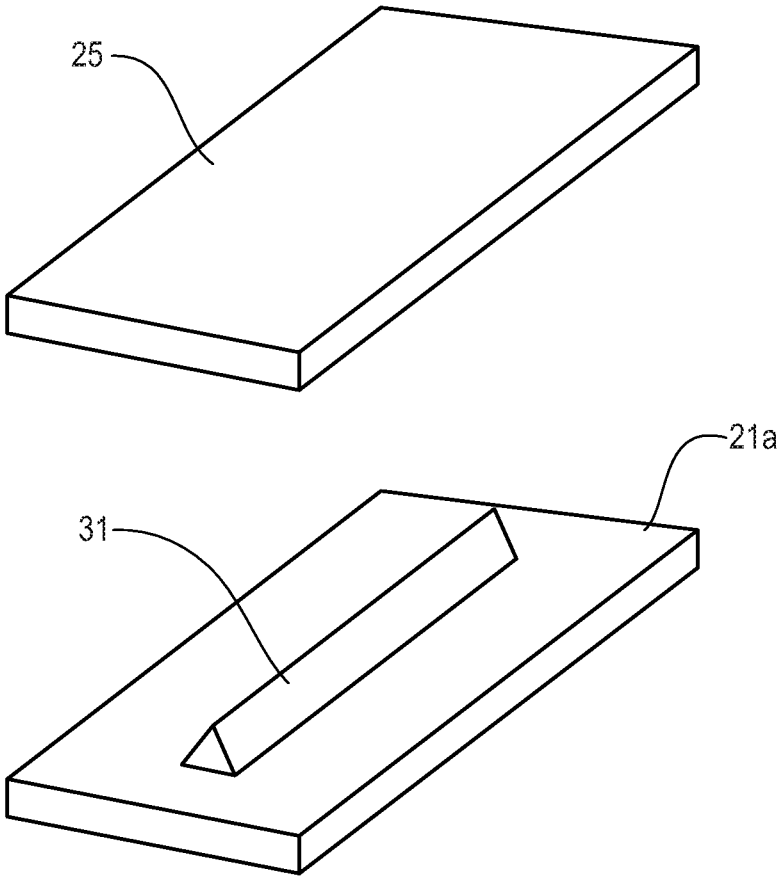
FIG. 3 is a perspective view illustrating media, an impression media, and a crease formation pattern according to an example.
Figure 4:
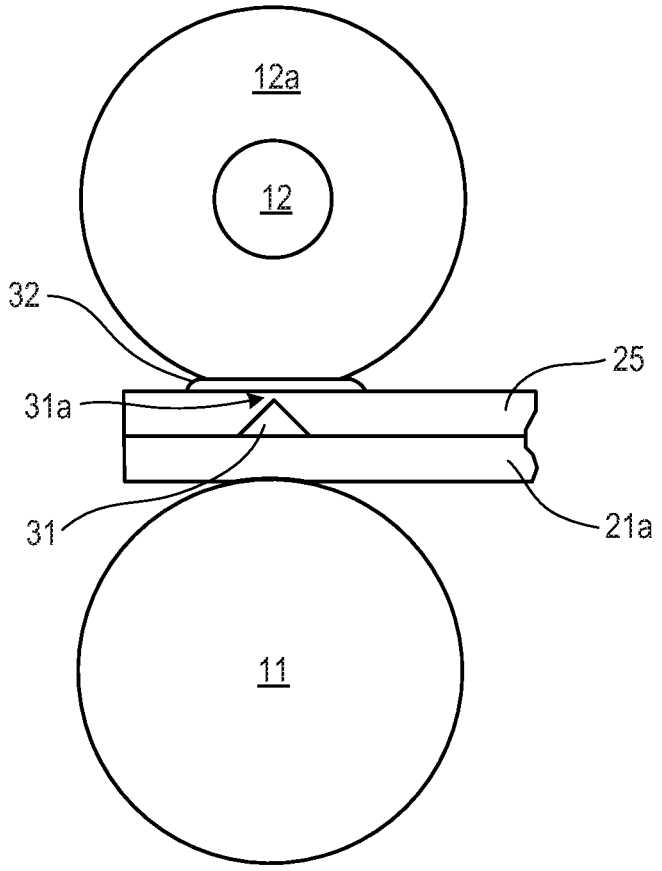
FIG. 4 is a side view illustrating formation of an image and a crease on media by an image forming system according to an example.

FIG. 3 is a perspective view illustrating media, an impression media, and a crease formation pattern according to an example. FIG. 4 is a side view illustrating formation of an image and a crease on media by an image forming system according to an example. Referring to FIGS. 2A-4, in some examples, a crease formation pattern 31 is formed on an impression media 21*a*, for example, directly by a supplemental print unit 26 (FIG. 2B) or indirectly by a print unit 10 (FIG. 2A). For example, the print unit 10 may indirectly form the crease formation pattern 31 on the impression media 21*a* by forming the crease formation pattern 31 on the PIP 24 to be transferred to the image forming blanket 12*a* and, subsequently, to be transferred to the impression media 21*a*. In some examples, the crease formation pattern 31 may be tapered and include a height to enable crease formation when pressed against the impression media 21*a*.

As illustrated in FIG. 4, the media 25 may be placed between and in contact with the image forming blanket 12*a* having an image 32 formed thereon and the impression medial 1 having the crease formation pattern 31 formed thereon. Pressure is applied to the media 25 from the intermediate transfer member 12 and the impression member 11. Accordingly, the image 32 may be transferred to the media 25 and a crease 31*a* corresponding to the crease formation pattern 31 may be formed on the media 25. That is, in some examples, the crease formation pattern 31 may be pressed into and indent one side of the media 25 as the image 32 on the image forming blanket 12*a* is pressed against and transferred to another side of the media 25. For example, image 32 and crease 31*a* formation on the media 25 may occur at a same image forming station.

Figure 5:
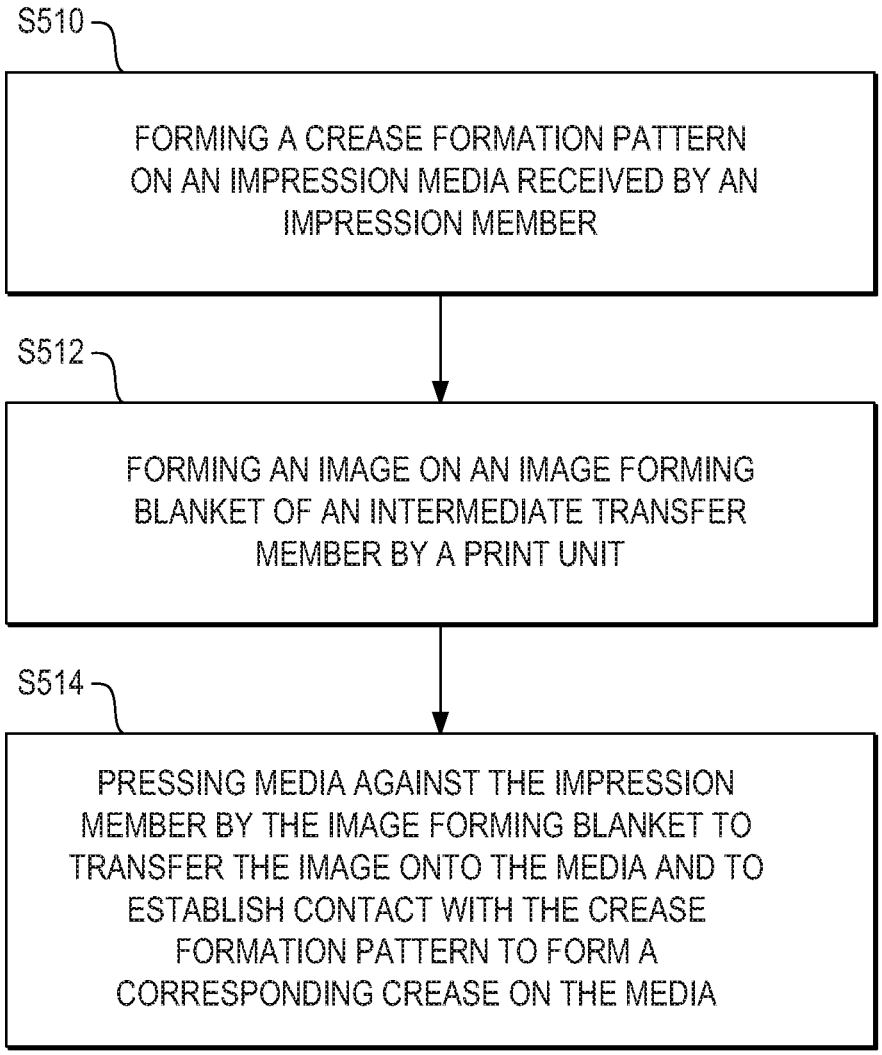
FIG. 5 is a flowchart illustrating a method of forming an image and a crease on media by an image forming system according to an example.

FIG. 5 is a flowchart illustrating a method of forming an image and a crease on media by an image forming system according to an example. Referring to FIG. 5, in block S510, a crease formation pattern may be formed on an impression media received by an impression member. In some examples, the crease formation pattern may be directly formed on the impression media by a supplemental print unit. Alternatively, the crease formation pattern may be indirectly formed on the impression media by the print unit. That is, a crease formation pattern may be formed on a PIP by the print unit, the crease formation pattern may be transferred from the PIP to the image forming blanket, and the crease formation pattern may be transferred from the image forming blanket to the impression media. Additionally, in some examples, multiple layers of ink may be formed on top of each other to form the crease formation pattern. In some examples, a subsequently-formed layer of ink having a smaller width may be formed on top of a previously-formed layer of ink having a greater width to form the crease formation pattern having a tapered end opposite to the impression media on which the crease formation pattern is formed.

In block S512, the image may be formed on an image forming blanket of an intermediate transfer member by a print unit. In block S514, media is pressed against the impression member by the image forming blanket to transfer the image onto the media and to establish contact with the crease formation pattern to form the corresponding crease on the media. For example, the media may be pressed against the impression member by the image forming blanket to transfer the image onto the media and to establish contact with the crease formation pattern on the impression media to form the corresponding crease on the media during the transfer of the image to the media.

Figure 6:
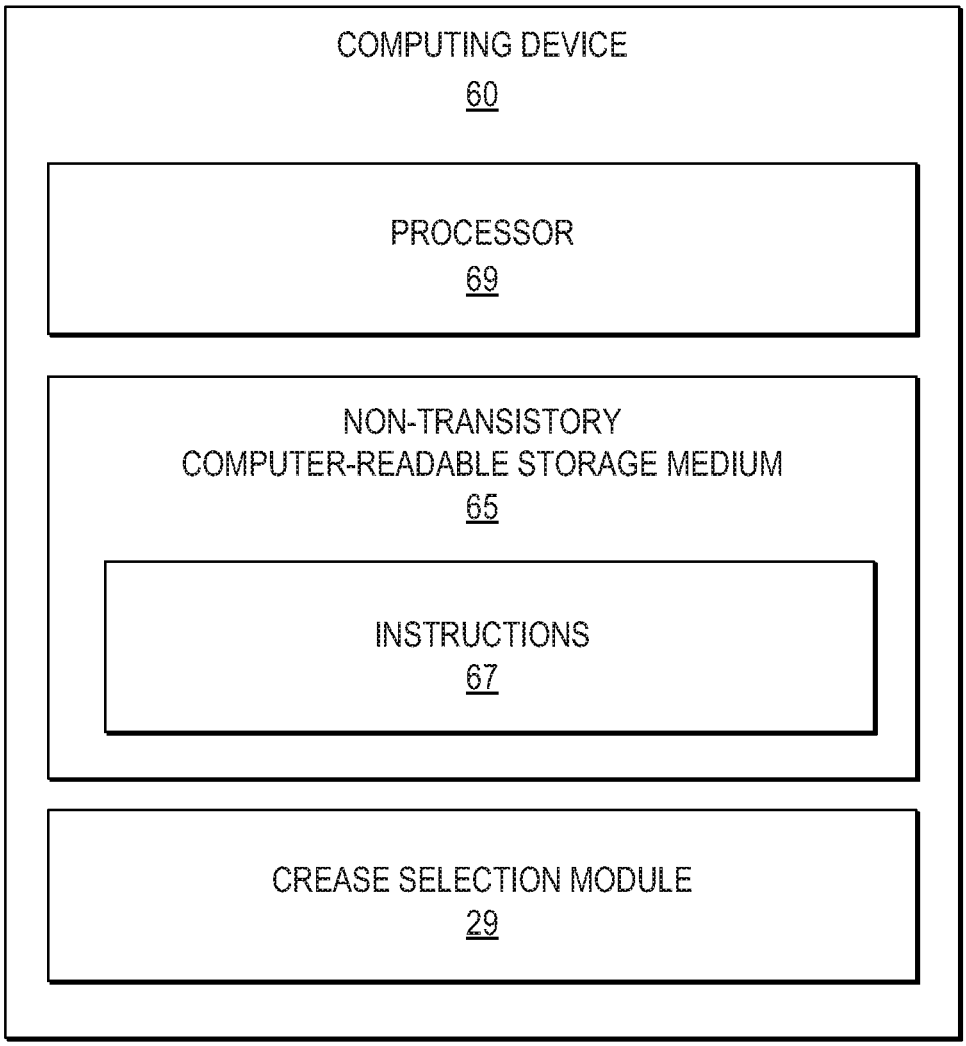
FIG. 6 is a block diagram illustrating a computing device such as an image forming system including a processor and a non-transitory, computer-readable storage medium to store instructions to form an image and a crease on media according to an example.

FIG. 6 is a block diagram illustrating a computing device such as an image forming system including a crease selection module 29, a processor and a non-transitory, computer-readable storage medium to store instructions to operate the computing device to form an image and a crease on media according to an example. Referring to FIG. 6, in some examples, the non-transitory, computer-readable storage medium 65 may be included in a computing device 60 such as an image forming system 100 (FIG. 1). In some examples, the non-transitory, computer-readable storage medium 65 may be implemented in whole or in part as computer-implemented instructions stored in the image forming system 100 locally or remotely, for example, in a server or a host computing device considered herein to be part of the image forming system 100.

Referring to FIG. 6, in some examples, the non-transitory, computer-readable storage medium 65 may correspond to a storage device that stores instructions 67 such as computer-implemented instructions, programming code, and the like. For example, the non-transitory, computer-readable storage medium 65 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM). The crease selection module 29 may enable selection of a crease formation pattern to be formed on an impression media. The crease formation pattern may correspond with formation of a crease on media during formation of an image on the media.

Referring to FIG. 6, examples of storage devices include, but are not limited to, hard disk drives, compact disc drives, digital versatile disc drives, optical drives, and flash memory devices. In some examples, the non-transitory, computer-readable storage medium 65 may even be paper or another suitable medium upon which the instructions 67 are printed, as the instructions 67 can be electronically captured, via, for instance, optical scanning of the paper or other medium, then compiled, interpreted or otherwise processed in a single manner, if necessary, and then stored therein. A processor 69 generally retrieves and executes the instructions 67 stored in the non-transitory, computer-readable storage medium 65, for example, to operate a computing device 60 such as an image forming system 100 to form an image and a crease on media by the image forming system 100 in accordance with an example. In an example, the non-transitory, computer-readable storage medium 65 may be accessed by the processor 69.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be scrambled relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A method of forming an image and a crease on media by an image forming system, the method comprising:

forming a crease formation pattern on an impression paper received by an impression member, which crease formation pattern forms a crease in the media along which the media is to be folded;

forming the image on an image forming blanket of an intermediate transfer member by a print unit; and pressing the media against the impression member by the image forming blanket to transfer the image onto the media and to establish contact with the crease formation pattern to form the corresponding crease on the media during the transfer of the image to the media.

2. The method of claim 1, further comprising passing the impression paper and the media through a nip formed by the impression member and the image forming blanket of the intermediate transfer member.

3. The method of claim 1, further comprising enabling selection of a predefined crease formation pattern to be formed on the impression paper.

4. The method of claim 1, further comprising enabling generation of a customized crease formation pattern to be formed on the impression paper.

5. The method of claim 1, in which forming a crease formation pattern on an impression paper is performed by a supplemental print unit separate from the print unit.

6. The method of claim 5, further comprising:

receiving the media at the image forming blanket; and receiving the impression paper at the supplemental print unit.

7. The method of claim 5, in which:

the image forming blanket contacts one side of the media; and the impression paper contacts an opposite side of the media.

8. The method of claim 1, in which forming a crease formation pattern on an impression paper is performed by the print unit.

9. The method of claim 1, in which forming a crease formation pattern on an impression paper comprises forming multiple layers of ink on top of each other to form the crease formation pattern.

10. The method of claim 1, further comprising using a non-transitory computer-readable storage medium having computer executable instructions stored thereon for an image forming system to form an image and a crease on media, the instructions are executable by a processor to:

form a crease formation pattern on an impression paper received by an impression member, which crease formation pattern forms a crease in the media along which the media is to be folded;

form the image on an image forming blanket of an intermediate transfer member by a print unit; and press the media against the impression member by the image forming blanket to transfer the image onto the media and to establish contact with the crease formation pattern to form the corresponding crease on the media during the transfer of the image to the media.

11. The method of claim 1, in which forming the crease formation pattern comprises:

receiving the crease formation pattern on the image forming blanket; and transferring the crease formation pattern to the impression paper.

12. The method of claim 11, in which forming the crease formation pattern comprises:

forming a crease formation pattern on a photo-imaging cylinder (PIP) by the print unit; and transferring the crease formation pattern from the PIP to the image forming blanket.

13. The method of claim 11, in which the crease formation pattern is transferred to the impression paper when the media is not disposed in a nip formed by the impression member and the image forming blanket of the intermediate transfer member.

14. The method of claim 1, in which forming a crease formation pattern on an impression paper received by an impression member comprises forming a subsequently-formed layer of ink having a smaller width on top of a previously-formed layer of ink having a greater width to form the crease formation pattern having a tapered end opposite to the impression paper on which the crease formation pattern is formed.

15. The method of claim 1, further comprising:

receiving selection of a predefined crease formation pattern to be formed on the impression paper, the selected predefined crease formation pattern being used as the crease formation pattern that forms a crease in the media along which the media is to be folded.

16. The method of claim 15, in which the crease formation pattern is directly formed on the impression paper.

17. The method of claim 16, in which the crease formation pattern is printed on the impression paper by a supplemental print unit.

18. The method of claim 15, in which the crease formation pattern is indirectly formed on the impression paper by the print unit.

19. The method of claim 15, in which, during pressing the media against the impression member by the image forming blanket to transfer the image onto the media and forming the crease formation pattern to form the corresponding crease on the media, the impression paper is below the media.

* * * * *